US005427034A

United States Patent [19]

Kilpatrick et al.

[11] Patent Number: 5,427,034

[45] Date of Patent: Jun. 27, 1995

[54] PALLET HAVING NOTCHED STINGER AND NOTCHED BRACE

[75] Inventors: Ted D. Kilpatrick, Ponte Vedra Beach, Fla.; Arthur M. Wagner, Geneva, Ill.

[73] Assignee: Jefferson Smurfit Corp. (U.S.), Valparaiso, Ind.

[21] Appl. No.: 201,345

[22] Filed: Feb. 24, 1994

Related U.S. Application Data

[63] Continuation-in-part of Ser. No. 74,942, Jun. 10, 1993, Pat. No. 5,370,061.

[51] Int. Cl.[6] ..... B65D 19/00

[52] U.S. Cl. ..... 108/51.3

[58] Field of Search ..... 108/51.3, 51.1, 56.1, 108/56.3

[56] References Cited

U.S. PATENT DOCUMENTS

| | | | |
|---|---|---|---|
| 2,446,914 | 8/1948 | Fallert et al. . | |
| 2,728,545 | 12/1955 | Hermitage . | |
| 2,955,791 | 10/1960 | George . | |
| 3,131,656 | 5/1964 | Houle . | |
| 3,165,078 | 1/1965 | White | 108/51.3 |
| 3,683,822 | 8/1972 | Roberts et al. | 100/51.3 |
| 4,792,325 | 12/1988 | Schmidtke | 108/51.3 |
| 4,867,074 | 9/1989 | Quansnick | 108/51.3 |
| 4,979,446 | 12/1990 | Winebarger | 108/51.3 |
| 5,001,991 | 3/1991 | Smith | 108/51.3 |
| 5,218,913 | 6/1993 | Winebargon et al. | 100/51.3 |

FOREIGN PATENT DOCUMENTS

| | | | |
|---|---|---|---|
| 1250352 | 4/1968 | Germany . | |
| 996516 | 6/1965 | United Kingdom | 108/51.3 |

*Primary Examiner*—Jose V. Chen

*Attorney, Agent, or Firm*—Dressler, Goldsmith, Shore & Milnamow

[57] ABSTRACT

A predominantly paperboard pallet is disclosed. Each of two outer stringers and one middle stringer or each of two outer stringers and two middle stringers is folded so as to have a given cross-section, preferably trapezoidal and tapering downwardly. Plural decking members having generally planar lower edges extend transversely through apertures in the respective stringers and are secured adhesively to the respective stringers. Each of two or four braces is folded so as to have a smaller cross-sections, preferably trapezoidal and tapering upwardly, and so as to have a generally planar upper edge. The middle stringer or middle stringers and the plural braces have interengaging notches and are secured adhesively to one another. The upper edge of each brace is secured adhesively to the lower edge of a selected decking member, on opposite sides of a selected stringer, which may be an outer stringer or a middle stringer. Each brace may have two notches, each receiving a portion of one of the middle stringers, whereupon each middle stringer has two notches with each notch receiving a portion of one such brace.

14 Claims, 1 Drawing Sheet

PALLET HAVING NOTCHED STINGER AND NOTCHED BRACE

This application is a continuation-in-part of U.S. patent application Ser. No. 08/074,942, now U.S. Pat. No. 5,370,061 which was filed Jun. 10, 1993, which is assigned commonly herewith, and the disclosure of which is incorporated herein by reference.

TECHNICAL FIELD OF THE INVENTION

This invention pertains to a pallet that may be predominantly made of paperboard material, such as corrugated paperboard, and comprising a longitudinally extending stringer, decking members extending transversely through apertures in the stringer, and at least one transversely extending brace. This invention contemplates that a generally planar upper edge of the brace is adjacent and may be adhesively secured to a generally planar lower edge of a decking member.

BACKGROUND OF THE INVENTION

Usage of shipping pallets made predominantly of corrugated paperboard material is widespread, primarily because of their low cost, recyclability, and cleanliness. Typically, such pallets employ longitudinally extending, transversely spaced stringers, which are made from folded pieces of corrugated paperboard. Such pallets also may employ transversely extending, longitudinally spaced decking members, which also are made from folded pieces of corrugated paperboard.

As described above, shipping pallets made predominantly of paperboard material, such as corrugated paperboard, are exemplified in Schmidtke U.S. Pat. No. 4,792,325, Quasnick U.S. Pat. No. 4,867,074, and Smith U.S. Pat. No. 5,001,991. Similar pallets made predominantly of corrugated paperboard are available commercially from Gate Pallet Systems, Inc. of Crown Point, Ind., under its PAYLOAD trademark.

Other pallets of related interest are disclosed in Hermitage U.S. Pat. No. 2,728,545, Houle U.S. Patent No. 3,131,656, Gifford U.S. Pat. No. 3,464,371, Childs U.S. Pat. No. 3,659,534, Roberts U.S. Pat. No. 3,683,822, Melli U.S. Pat. No. 4,563,377, British Patent Specification No. 996,516, German Patent No. 1,250,352, and Swiss Patent No. 512,367.

As disclosed in Smith U.S. Pat. No. 5,001,991, it is known to increase the lateral stability and load-carrying capacity of such a pallet by means of tubular reinforcing pieces, which have slots interengaging with slots in the stringers. It is disclosed therein that tightly wound paper tubing, such as that used for cores for paper rolls, is a suitable material for such pieces.

In U.S. patent application Ser. No. 08/074,942, supra, several embodiments of an improved pallet are disclosed, in which at least one longitudinally extending stringer and at least one transversely extending brace are employed in a novel combination. As disclosed therein, a notch in the stringer interengages with a notch in the brace, and the notches are dimensioned so that the stringer and the brace are substantially coplanar at their upper and lower edges. Each embodiment of the improved pallet, as disclosed therein, is noteworthy for its lateral stability and load-carrying capacity.

This invention has resulted from efforts further to increase the lateral stability and load-carrying capacity of a shipping pallet that may be predominantly made of paperboard material.

SUMMARY OF THE INVENTION

This invention provides a further improved pallet, which is similar in some respects to the improved pallets disclosed in U.S. Patent Application Serial No. 08/074,942, supra, but in which a generally planar upper edge of a transversely extending brace is adjacent and may be adhesively secured to a generally planar lower edge of a decking member.

Generally, the pallet provided by this invention comprises a stringer folded from a single sheet of paperboard material so as to have a given cross-section, a plurality of decking members extending transversely through apertures in the stringer and including a selected decking member having a generally planar lower edge, and at least one transversely extending brace folded from a single sheet of paperboard material so as to have a smaller cross-section, as compared to the cross-section of the stringer, and so as to have a generally planar upper edge.

Further, the brace has a notch intersecting the generally planar upper edge of the brace and receiving a portion of the selected stringer, and the stringer has a notch receiving a portion of the brace. Moreover, the notches interengage with each other such that the generally planar upper edge of the brace is adjacent to the generally planar lower edge of the selected decking member, on opposite sides of the stringer.

Preferably, the decking members are secured adhesively to the stringer, and the brace is secured adhesively to the stringer at the interengaging notches. If so, the generally planar upper edge of the brace is secured adhesively to the generally planar lower edge of the selected decking member, on opposite sides of the selected stringer.

Thus, the brace may be one of two similar braces spaced from each other along the stringer, which may be a middle stringer between two outer stringers. Also, the brace may be one of four similar braces spaced from each other along each of two outer stringers, whether or not there is a middle stringer.

This invention contemplates that the pallet may comprise four longitudinally extending stringers including two outer stringers and two middle stringers between the outer stringers, each middle stringer being folded from a single sheet of paperboard material so as to have a given cross-section, a plurality of decking members extending transversely through apertures in the respective stringers and including a selected decking member having a generally planar lower edge, and at least one transversely extending brace folded from a single sheet of paperboard material so as to have a smaller cross-section, as compared to the cross-section of each middle stringer, and so as to have a generally planar upper edge.

If so, the brace has two notches, each notch intersecting the generally planar upper edge of the brace and receiving a portion of a respective one of the middle stringers, and each middle stringer has a notch receiving a portion of the brace. If so, the notches interengage with each other such that the generally planar upper edge of the brace is adjacent to the generally planar lower edge of the selected decking member, on opposite sides of a respective one of the middle stringers.

Thus, the decking members may be adhesively secured to the respective stringers, and the brace may be adhesively to the middle stringers at the interengaging notches. Also, the generally planar upper edge of the brace may be adhesively secured to the generally planar lower edge of the selected decking member, on opposite sides of each of the middle stringers.

Preferably, the selected decking member is one of two selected decking members spaced longitudinally from each other and having generally planar lower edges, and the brace is one of two similar braces spaced from each other along the middle stringers and having generally planar upper edges. If so, the generally planar upper edge of each of the similar braces is adjacent to the generally planar lower edge of a respective one of the selected decking members, on opposite sides of each of the middle stringers.

These and other objects, features, and advantages of this invention are evident from the following description of a preferred embodiment of this invention with reference to the accompanying drawings.

DETAILED DESCRIPTION OF ILLUSTRATED EMBODIMENTS

Figure 1:
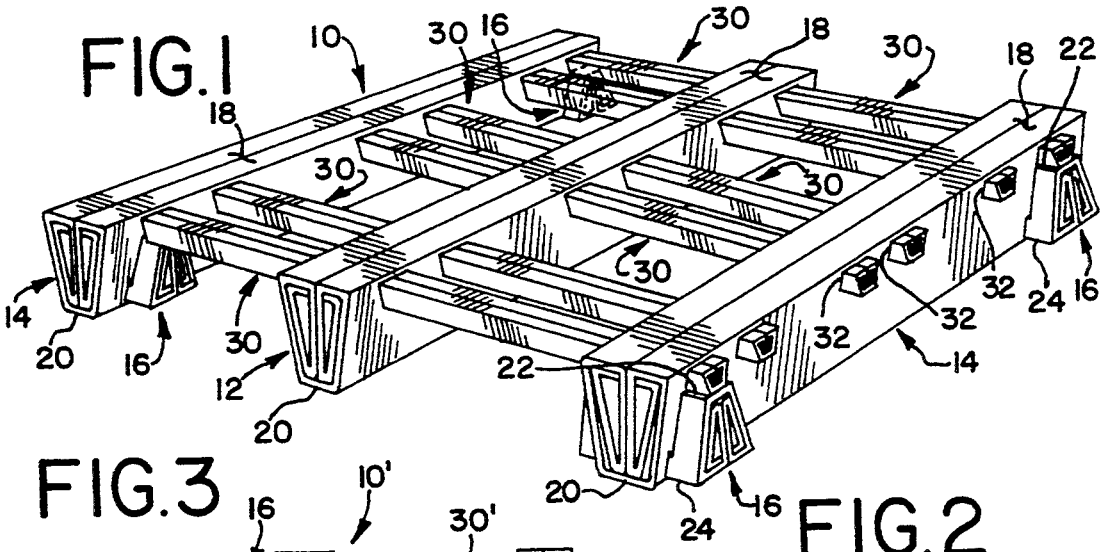
FIG. 1 is a perspective view of a predominantly paperboard pallet constituting a first embodiment of this invention.
Figure 3:
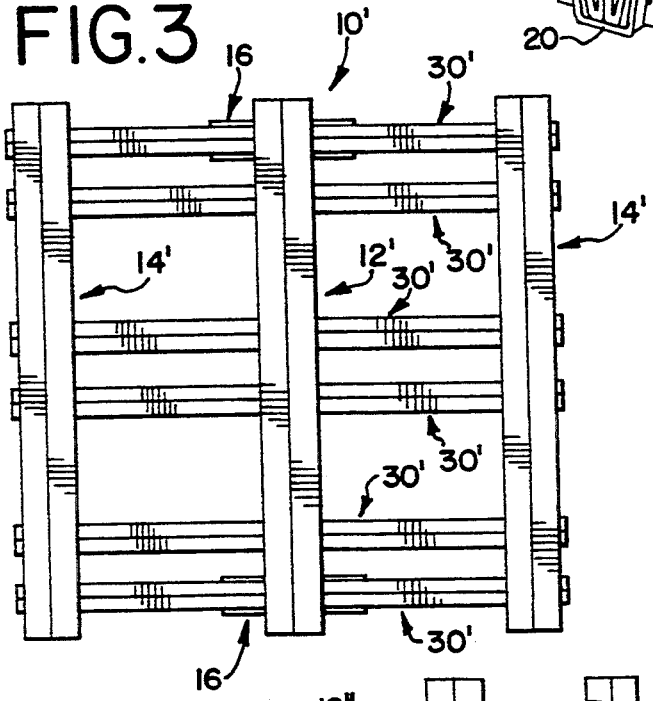
FIG. 3 is a plan view of a predominantly paperboard pallet constituting a second embodiment of this invention.

As shown in FIG. 1, a pallet 10 made predominantly of paperboard material constitutes a first embodiment of this invention. The pallet 10 comprises three relatively long, longitudinally extending stringers, namely a middle stringer 12 and two outer stringers 14. The pallet 10 further comprises four relatively short, transversely extending braces 16, which brace the outer stringers 14. The braces 16 are arranged in two transversely aligned pairs, near the ends of the outer stringers 14.

Each of the stringers 12, 14, is folded from a single sheet of paperboard material so as to have a downwardly tapering, trapezoidal cross-section. The trapezoidal cross-sections of the stringers 12, 14, are substantially identical. Each of the braces 16 is folded from a single sheet of paperboard material so as to have an upwardly tapering, trapezoidal cross-section, which is substantially similar to the trapezoidal cross-section of each of the stringers 12, 14, but which is smaller as compared to the trapezoidal cross-section thereof, and which is inverted as compared thereto.

Preferably, as shown, in each of the stringers 12, 14, and in each of the braces 16, eleven panels define a trapezoidal cross-section conforming to the trapezoidal cross-section of the improved stringer illustrated and described in a copending patent application, U.S. patent application Ser. No. 08/038,001 filed Mar. 29, 1993, and assigned commonly herewith, except that the trapezoidal cross-section of each of the braces 16 is smaller and is inverted, as compared to the trapezoidal cross-section of each of the stringers 12, 14. The disclosure of the copending patent application, U.S. patent application Ser. No. 08/038,001, is incorporated herein by reference. As disclosed in the copending patent application, U.S. patent application Ser. No. 08/038,001, certain of the folded panels are secured adhesively to other panels.

Alternatively, each of the stringers 12, 14, and each of the braces 16 may conform in their cross-sections to the trapezoidal cross-section of the pallet stringer disclosed in Quasnick U.S. Pat. No. 4,867,074, except that the trapezoidal cross-section of each of the braces 16 is smaller and is inverted, as compared to the trapezoidal cross-section of each of the stringers 12, 14. The disclosure of Quasnick U.S. Pat. No. 4,867,074 also is incorporated herein by reference.

Because of its trapezoidal cross-section, each of the stringers 12, 14, has a relatively wide, substantially planar, upper edge 18 and a relatively narrow, substantially planar, lower edge 20. Because of its inverted, trapezoidal cross-section, each of the braces 16 has a relatively narrow, substantially planar, upper edge 22 and a relatively wide, substantially planar, lower edge 24. The upper edges 18 of the stringers 12, 14, are substantially coplanar. The upper edges 22 of the braces 16 are substantially coplanar, below the upper edges of the stringers 12, 14. The lower edges 20 of the stringers 12, 14, and the lower edges 24 of the braces 16 are substantially coplanar.

Figure 2:
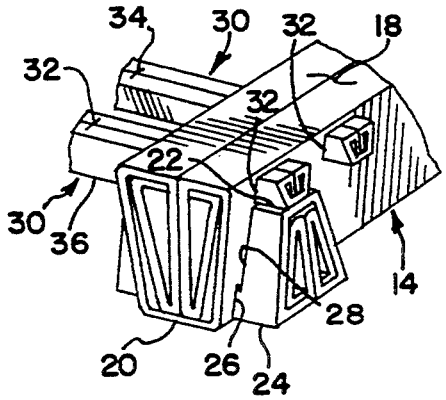
FIG. 2 is an enlarged, fragmentary detail of one corner portion of the pallet, as shown in FIG. 1.

One notch 26 of one outer stringer 14 and the notch 28 of one brace 16 are shown in FIG. 2. The notch 26, which flares downwardly, conforms to and receives a lower portion 30 of the brace 16 having the notch 28. The notch 28, which flares upwardly, conforms to and receives an upper portion 32 of the outer stringer 14. The other notches of the outer stringers 14 are similar to the notch 26 and conform to and receive lower portions of the other braces 16. The notches of the other braces 16 are similar to the notch 28 and conform to and receive an upper portion of one of the outer stringers 14. The notches, which interengage with each other at each of the braces 16, are dimensioned so that the middle stringer 12 and the braces 16 are substantially coplanar at their lower edges 20, 24, but not at their upper edges 18, 22. The outer stringers 14 are secured adhesively to the braces 16 at the interengaging notches.

The pallet 10 further comprises six decking members 30, which extend transversely through apertures 32 in the stringers 12, 14. The decking members 30 are secured adhesively to the stringers 12, 14, at margins of the apertures 32. Each decking member 30 is folded from a single sheet of paperboard material, such as the material used for the stringers 12, 14, so as to have multiple panels, some of which panels are secured adhesively to other panels of such decking member 30. Each decking member 30 is similar to the decking members disclosed in Schmidtke U.S. Pat. No. 4,792,325, the disclosure of which is incorporated herein by reference.

Because of its trapezoidal cross-section, each of the decking members 30 has a relatively wide, substantially planar, upper edge 34 and a relatively narrow, substantially planar, lower edge 36. When the decking members 30 are secured adhesively to the stringers 12, 14, the lower edges 36 of the decking members 30 are substantially coplanar.

The outer stringers 14, the braces 16, and the decking members 30 are assembled so that the generally planar upper edge 22 of each brace 16 is adjacent to the generally planar lower edge 36 of a selected one of the decking members 30. Preferably, the generally planar upper edge of each brace 16 is adjacent to the generally planar lower edge 36 of the decking member 30 nearest to one end of each of the stringers 12, 14, as shown. The generally planar upper edge 22 of each brace 16 secured adhesively to the generally planar lower edge of the selected one of the decking members 30.

As shown in FIG. 2, in which primed reference numbers refer to elements similar to elements referenced by similar, unprimed reference numbers in FIGS. 1 and 2, a pallet 10' made predominantly of paperboard material constitutes a second embodiment of this invention. Except as illustrated and described, the pallet 10' is similar to the pallet 10. The pallet 10' comprises three relatively long, longitudinally extending stringers, namely a middle stringer 12' and two outer stringers 14'. The pallet 10' further comprises two relatively short, transversely extending braces 16' which brace the middle stringer 12'. The braces 16' are arranged near the ends of the middle stringer 14'.

The pallet 10' further comprises six decking members 30', which extend transversely through apertures (not shown) in the stringers 12', 14'. The decking members 30' are secured adhesively to the stringers 12', 14' at margins of the apertures in the stringers 12' 14'.

In the pallet 10', each of the braces 16' has an upwardly flaring notch (similar to the notch 28 in FIG. 2) interengaging with a downwardly flaring notch (similar to the notch 26 shown in FIG. 2) in the middle stringer 12'. Otherwise, the middle stringer 12' the braces 16' and the outermost decking members 30' are assembled and are secured adhesively to one another, as the outer stringers 14, the braces 16, and the outermost decking members 30 are assembled and are secured adhesively to one another, in the pallet 10.

Figure 4:
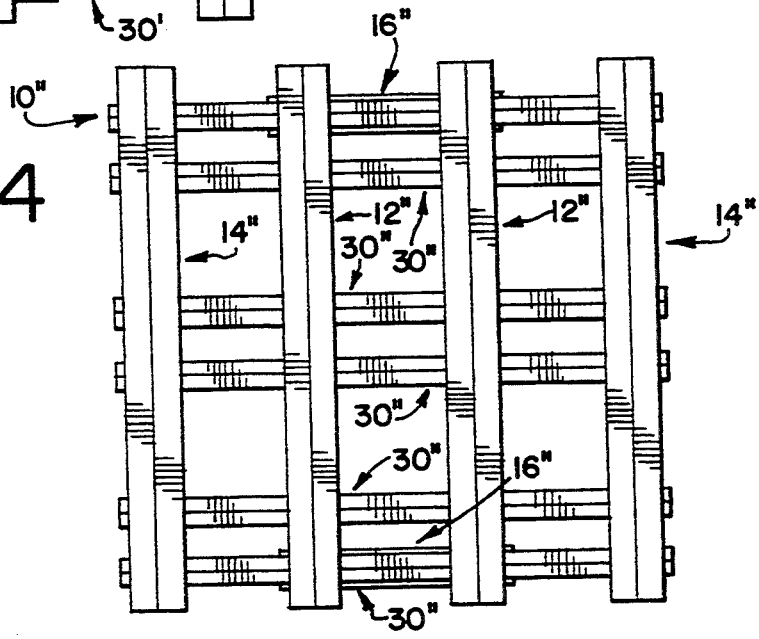
FIG. 4 is a plan view of a predominantly paperboard pallet constituting a third embodiment of this invention.

As shown in FIG. 4, in which double-primed reference numbers refer to elements similar to elements referenced by similar, unprimed reference numbers in FIGS. 1 and 2, a pallet 10'' made predominantly of paperboard material constitutes a second embodiment of this invention. Except as illustrated and described, the pallet 10'' is similar to the pallet 10. The pallet 10'' comprises four relatively long, longitudinally extending stringers, namely two middle stringers 12'' and two outer stringers 14''. The pallet 10'' further comprises two relatively short, transversely extending braces 16'', which join and brace the middle stringers 12''. The braces 16'' are arranged near the ends of the middle stringer 14''.

The pallet 10'' further comprises six decking members 30'' which extend transversely through apertures (not shown) in the stringers 12'' 14'' The decking members 30'' are secured adhesively to the stringers 12'', 14'', at margins of the apertures in the stringers 12'', 14''.

In the pallet 10'', each of the braces 16'' has two upwardly flaring notches (similar to the notch 28 in FIG. 2) each interengaging with a downwardly flaring notch (similar to the notch 28 in FIG. 2) in a respective one of the middle stringers 12''. Otherwise, the middle stringers 12'' the braces 16'' and the outermost decking members 30'' are assembled and are secured adhesively to one another, as the outer stringers 14'' the braces 16'' and the outermost decking members 30'' are assembled and are secured adhesively to one another, in the pallet 10, and as the middle stringer 12' the braces 16' and the outermost decking members 30' are assembled and are secured adhesively to one another, in the pallet 10'.

Where adhesive securement is described above, a so-called "cold melt" or "cold set" adhesive is suitable, such as Code No. 3715 or Code No. 3715B, both of which are available commercially from H.B. Fuller Co. of Palatine, Ill.

Various modifications may be made in any of the several embodiments described above without departing from the scope and spirit of this invention.

We claim:

1. A pallet comprising a stringer extending longitudinally and folded from a single sheet of paperboard material so as to have a given cross-section, a plurality of decking members extending transversely through apertures in the stringer and including a selected decking member having a generally planar, lower edge, and at least one elongate, transversely extending brace folded from a single sheet of paperboard material so as to have a polygonal cross-section, which is uniform along the brace and which is smaller as compared to the cross-section of the stringer, and which provides the brace with a generally planar, upper edge, the brace having a notch intersecting the generally planar upper edge of the brace and receiving a portion of the stringer, the selected stringer having a notch receiving a portion of the brace, the notches interengaging with each other such that the generally planar upper edge of the brace is adjacent to the generally planar lower edge of the selected decking member, on opposite sides of the stringer.

2. The pallet of claim 1 wherein the decking members are secured adhesively to the stringer, wherein the brace is secured adhesively to the stringer at the interengaging notches, and wherein the generally planar upper edge of the brace is secured adhesively to the generally planar lower edge of the selected decking member, on opposite sides of the selected stringer.

3. The pallet of claim 1 wherein the brace is one of two similar braces spaced from each other along the stringer.

4. The pallet of claim 3 wherein the selected decking member is one of two selected decking members having generally planar lower edges and wherein each of the similar braces has a generally planar upper edge adjacent to the generally planar lower edge of a respective one of the selected decking members, on opposite sides of the stringer.

5. The pallet of claim 1 wherein the stringer is a middle stringer between two outer stringers.

6. The pallet of claim 5 wherein the brace is one of two similar braces spaced from each other along the middle stringer.

7. The pallet of claim 1 wherein the stringer is one of two outer stringers and wherein the brace is one of four similar braces including two such braces spaced from each other along each of the outer stringers.

8. The pallet of claim 1 further comprising at least one middle stringer between the outer stringers.

9. A pallet comprising four longitudinally extending stringers including two outer stringers and two middle stringers between the outer stringers, each middle stringer being folded from a single sheet of paperboard material so as to have a given cross-section, a plurality of decking members extending transversely through apertures in the respective stringers and including a selected decking member having a generally planar, lower edge, and at least one elongate, transversely extending brace folded from a single sheet of paperboard material so as to have a polygonal cross-section which is uniform along the brace and which is smaller as compared to the cross-section of each middle stringer, and which provides the brace with a generally planar, upper edge, the brace having two notches, each notch intersecting the generally planar upper edge of the brace and receiving a portion of a respective one of the middle stringers, each middle stringer having a notch receiving a portion of the brace, the notches interengaging with each other such that the generally planar upper edge of the brace is adjacent to the generally planar lower edge of the selected decking member, on opposite sides of a respective one of the middle stringers.

10. The pallet of claim 9 wherein the decking members are secured adhesively to the respective stringers, wherein the brace is secured adhesively to the middle stringers at the interengaging notches, and wherein the generally planar upper edge of the brace is secured adhesively to the generally planar lower edge of the selected decking member, on opposite sides of each of the middle stringers.

11. The pallet of claim 9 wherein the selected decking member is one of two selected decking members spaced longitudinally from each other and having generally planar lower edges, wherein the brace is one of two similar braces spaced from each other along the middle stringers and having generally planar upper edges, and wherein the generally planar upper edge of each of the similar braces is adjacent to the generally planar lower edge of a respective one of the selected decking members, on opposite sides of each of the middle stringers.

12. The pallet of claim 11 wherein the decking members are secured adhesively to the respective stringers, wherein the braces are secured adhesively to the middle stringers at the interengaging notches, and wherein the generally planar upper edge of each brace is secured adhesively to the generally planar lower edge of a respective one of the selected decking members, on opposite sides of each of the middle stringers.

13. The pallet of claim 9 wherein the stringer has a relatively wide, generally planar, upper edge and a relatively narrow, generally planar, lower edge and wherein the brace has a generally planar, lower edge, which is wider than the generally planar, upper edge of the brace.

14. The pallet of claim 1 wherein the stringer has a relatively wide, generally planar, upper edge and a relatively narrow, generally planar, lower edge and wherein the brace has a generally planar, lower edge, which is wider than the generally planar, upper edge of the brace.

* * * * *